United States Patent [19]

Goeltz

[11] Patent Number: 4,811,940

[45] Date of Patent: Mar. 14, 1989

[54] PILE-HEIGHT BAR GOVERNOR FOR PRINTING PRESS PILE FEEDERS

[76] Inventor: Jeffrey Goeltz, 24483 Chippendale Avenue, Farmington, Minn. 55024

[21] Appl. No.: 44,233

[22] Filed: Apr. 30, 1987

[51] Int. Cl.[4] ..... B65H 1/18

[52] U.S. Cl. ..... 271/155

[58] Field of Search ..... 271/25, 31, 38, 130, 271/152, 154, 155

[56] References Cited

U.S. PATENT DOCUMENTS

| | | | |
|---|---|---|---|
| Re. 32,281 | 11/1986 | Tsubo | 271/155 X |
| 2,746,753 | 5/1956 | Battey | 271/31 |
| 2,866,640 | 12/1958 | Rives | 271/154 X |
| 2,912,243 | 11/1959 | Gulick | 271/25 X |
| 3,716,226 | 2/1973 | Kistner | 271/154 X |
| 4,358,101 | 11/1982 | Janecek | 271/31 X |

*Primary Examiner*—Richard A. Schacher
*Attorney, Agent, or Firm*—Warren A. Sturm

[57] ABSTRACT

An accessory for paper supply feeders on standard printing presses of the class utilizing a paper supply pile height sensor to position a platform having a substantial stack of paper to be fed to a printing press includes an adjustable, variable force biasing means for alleviating the downward force of a reciprocating cyclically applied pile height sensor as the sensor is applied to the top of a stack of paper so that the supply at the top of the stack does not become distorted. This permits the printing press to operate with a greater paper supply capacity while eliminating misfeeds or other interruptions in operation, reduces the set-up time and allows the press to be operated for substantially longer periods of time without requiring an operator's attention.

1 Claim, 1 Drawing Sheet

PILE-HEIGHT BAR GOVERNOR FOR PRINTING PRESS PILE FEEDERS

BACKGROUND OF THE INVENTION

1. Field of the Invention.

This invention relates to printing presses and is more particularly directed to a governor for controlling the operation of the positioning control for providing a continuous supply of items, such as sheets of paper, envelopes and the like to the document feeding mechanism of a printing press.

2. Prior Art.

The following examples of prior art relating generally to printing presses and the like were determined in the course of a patentability search for the novel and unobvious invention of this application:

| Number | Date | Inventor | Invention |
|---|---|---|---|
| 3,869,116 | Mar. 4, 1975 | Krocker | Decreasing Load Deflection Mechanism |
| 3,961,785 | June 8, 1976 | Gall | Arrangement for Respectively Withdrawing A Single Film Sheet from a Strack of Directly Loosely Superimposed Film Sheets |
| 4,305,577 | Dec. 15, 1981 | Clay et al. | Apparatus for Applying, Varying and Removing a Normal Force in a Shingler Wheel Type Document Feeder |
| 4,524,965 | Jun. 25, 1985 | Kulpa | Envelope Stacking Machine |

A typical printing press that may be operable and will benefit from the application of the principles of my invention is comprised of a printing mechanism such as a rotary offset printing apparatus disposed at one end of a frame and cabinet, a paper feeder disposed intermediate the ends of the cabinet or frame and a paper supply table disposed at the opposite end of the cabinet or frame and which is adapted to accept a stack of material to be printed and to maintain the top of the stack at a position whereat the top of the articles stored on the top of the moveable table will be in position to be engaged by the feeder mechanism and transferred from the supply pile to the printing apparatus. The height of the top of the pile of material on the vertically moveable table, therefore, is continuously sensed by a pile height bar, or sensor, that is applied with considerable force to the top of the pile of material to be printed on the top of the table during each cycle of operation of the printing press and where the material needs to be repositioned, so as to be consistantly and efficiently transferred by the feeding mechanism, is adjusted in accordance with the height sensed by the pile height bar or sensor. Continuous operation of the printing press results in the complete depletion of the entire pile of material to be printed without interruption.

When, for example, the material to be printed consists of folded paper, envelopes and/or material that is susceptible of compression when disposed in a pile, considerable interruptions occur by way of jamming or misfeeds due to the distortion of, for example, the ends of a pile of material to be printed as the substantial downward biasing forth of the pile height bar, or sensor, engages the top of the pile to determine the height during each cycle of operation of the printing press. The malfunctioning resulting from this action presents greatly increased labor costs and inefficiency and, when the problem is partially alleviated, as by severely restricting the amount or number of items to be printed that are contained in a stack or pile of material on the supply table, the printing press will still be operable under conditions of lower efficiency because of the increased frequency of attention required by an operator of the printing press to replenish the supply of items to be printed in smaller stacks.

SUMMARY OF THE INVENTION

My invention is operable in connection with, for example, an ATF Davidson-White, Chief Model, Offset Lithographic Printing Press forming the basis for the illustrated preferred embodiment. When applied to this and other forms of printing presses utilizing a stack or pile of stock to be printed, the method and apparatus of my invention provides an increased efficiency of operation through the elimination of effort in the form of labor to replenish a pile of stock or to correct malfunctions occasioned by problems associated with the transfer of stock to be printed from a pile to the printing portion of a press.

Specifically, the control for maintaining the top of a stack of material to be printed in proper disposition for co-action with a stock feeding mechanism to transfer the material from the stack to the printing apparatus is effected in such a manner that a larger quantity of stock may be placed in a pile while permitting the normal operation of a control system adapted to maintain the top of the pile at a pre-determined level or height. In typical printing presses, the pile height is determined, or checked during each cyle of operation of the printing press by applying a feeler or pile height bar with considerable force to the top of the pile of printing stock. My invention provides a method and apparatus for reducing the force exerted on the top of the stock pile so that distortion of the pile does not occur when the top of the pile is engaged by a sensor exhibiting a substantially lesser than normal force onto the top of the stock pile.

Briefly, my method and apparatus is concerned with reducing the affect of a biasing force applied to a stock pile size or height sensing mechanism to preclude or prevent and thereby eliminate, undesireable distortion of a stock pile and to thereby permit uninterrupted operation, from a larger stock pile, of printing presses of the class with which my invention is concerned.

DETAILED DESCRIPTION OF THE ILLUSTRATED PREFERRED EMBODIMENT

Figure 1:
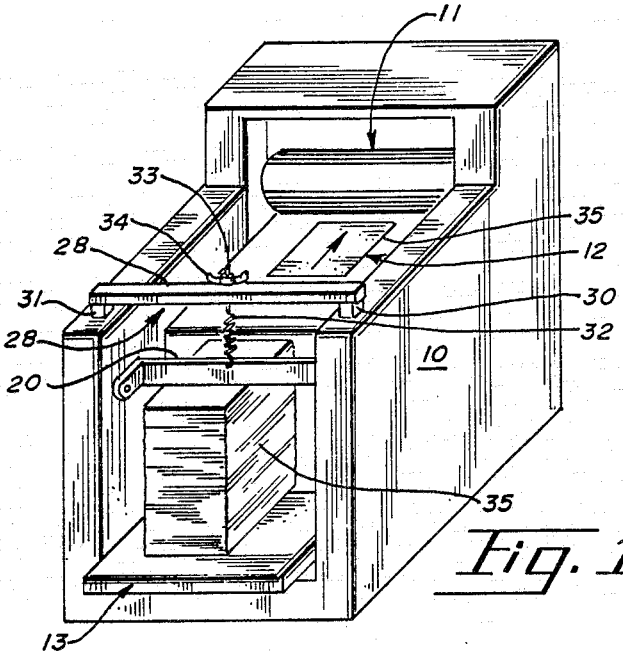
FIG. 1 is a perspective representation of a typical offset printing press to which my invention has been applied.
Figure 2:
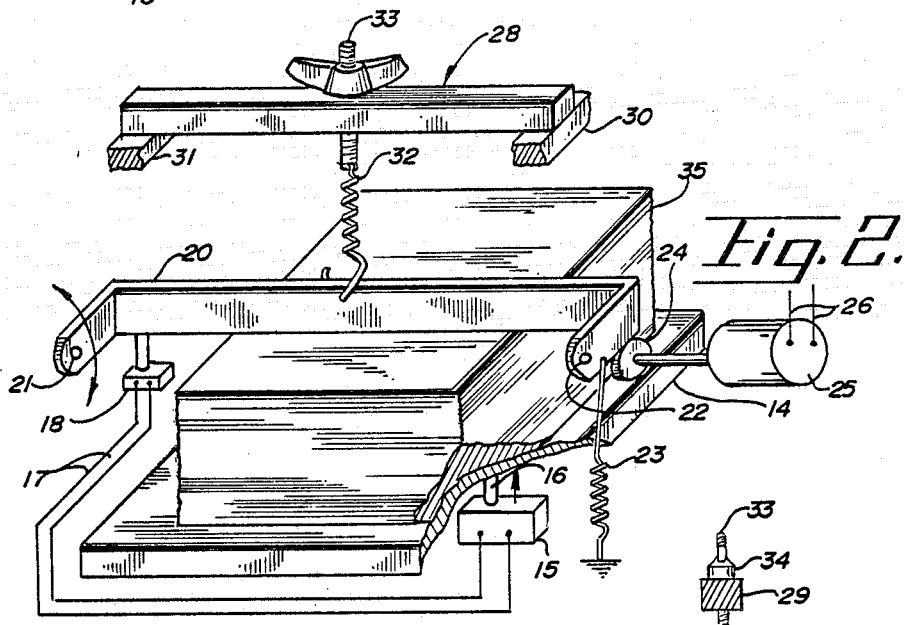
FIG. 2 is an enlarged, partial and schematic representation of a portion of FIG. 1.

Referring to the drawings, an offset printing press is indicated generally by reference character 10 and includes a rotary printing appartus 11, a paper transfer feeder 12, and a paper supply indicated generally by reference character 13, all of which co-act to repetitively and continuously print desired information upon various and sundry printing media. Briefly, the press will operate to release the top of a stock pile of printing media, shown in the form of a paper stock pile 35, to a paper transfer feeder 12 which will convey the paper to the rotary printing mechanism 11 and then to a bin (not shown) for receiving and storing the printed materials processed by the press. The illustrated printing press is generally that of the CHIEF model manufactured by ATF-Davidson-White.

Referring back to the drawings, paper supply 13 includes a vertically moveable table 14 for receiving a stock pile of printing media, such as paper indicated by reference character 35. Table 14 is connected to a suitable electric driving means 15 having an output drive 16 connected to the bottom of table 14 to continuously move table 14 in a vertically upward direction as the stock pile 35 is depleted in the course of operation of the printing press. The electric driving means 15 is connected by suitable wires 17 to a switch 18 having an upwardly extending actuator for engagement by a pile height bar 20. Driving means 15 and switch 18 cooperate with a source of power (not shown) to reposition table 14 as may be desired or becomes necessary in the course of operation of the printing press.

A pile height bar 20 is shown rotatively disposed upon shafts 21 and 22 mounted on opposing inner side portions of the supply end of offset printing press 10. Pile height bar 20 is biased downwardly by a spring 23 suitably connected to a stationary portion of printing press 10 and pile height bar 20 is further connected to a cam 24 driven by a motor 25 connected through conductors 26 to a source of energization determined by the controls for the press which provide for operation of cam 24 once during each cycle of operation of the press so as to move pile height bar upwardly to thereby remove pile height bar 20 from the top of stock pile 35 so as to permit the withdrawal and transfer of the top portion of printing media in the pile.

A pile height bar governor, indicated generally by reference character 28, is shown having a support bar 29 disposed above pile height bar 20 on top of support blocks 30 and 31 and includes a downwardly extending spring 32 connected at its lower end to pile height bar 20 and at its upper end to a screw threaded member extending upwardly through support bar 29 and adjustably disposed therethrough by threaded member 34.

Figure 3:
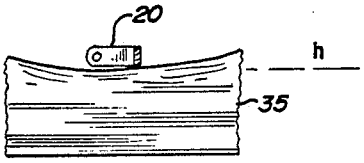
FIGS. 3 and 4 are sectional fragmentary side views of portions of FIGS. 1 and 2 illustrating the operation of my invention.

FIG. 3 illustrates a pile height bar operable with a stack of compressable printing media, such as envelopes (indicated by reference character 35) and without the benefit of the principles of my invention, the stack is compressed at the center and the sides rise above the line indicated by h that is representative of the desired height to be maintained for consistant satisfactory operation of paper feeder 12 in the operation of the press and under the conditions depicted in FIG. 3, the chance of jamming and or misfeeds increases and the press will no longer operate reliably.

Figure 4:
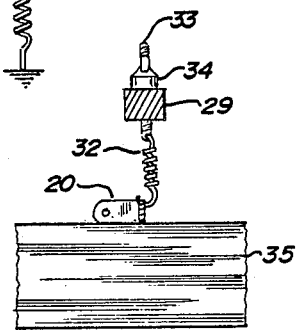

On the other hand, the application of my invention as illustrated in FIG. 4, results in a considerable reduction in the down-force exerted by pile height bar 20 and spring 23 so that stock pile 35 does not become distorted and the height is consistant with the desired height h and the press will operate reliably and satisfactorily with a large supply of printing media in stock pile 35.

OPERATION

As described above, the normal operation of the illustrated printing press is to provide a supply of printing media, 35, at the input end, and maintain the top of the supply at a pre-determined level, which permits the withdrawal of the top of the stack by a transfer-feeder 12 to printing mechanism 11 and then out of the machine. Further, as described above, the stock pile of printing media is disposed on top of a vertically moveable table 14 which is operable in response to the cyclical position of a pile height bar sensor 20 to maintain the top of the pile at a pre-determined desired level or height with respect to paper transfer-feeder 12.

As may now be understood, my improved method and apparatus required adjustment commeasurate with the compressability characteristics of the individual components of stock pile 35 so as to attain the relationship illustrated in FIG. 4 and to prevent the malfunctions occuring with the relationship existing in the illustration of FIG. 3.

Therefore, when a supply of printing stock exhibits compressable characteristics, such as envelopes and the like, a printing press such as offset printing press 10 is initially operated so that the stock pile of material carried on table 14 cycles up to a point whereat misfeeds or jams occur as by running the press and adjusting the tension on spring 32 by rotating adjusting nut 34; then adjusting nut 34 is rotated in the opposite direction so that the apparatus operates normally and a slight adjustment in the first direction to cause of the table to rise provides a fine tuning of the entire system so that the press 10 may be operable to consume the entire amount of a substantial supply of stock without further attention by an operator to thereby conserve time and energy and improve the overall efficiency of a printing operation.

I claim:

1. In combination with a stock feeder for an offset printing press in which the height of a stock pile is to be maintained at a pre-determined level;

a pile-height bar comprised of lever means operable between a lower position of engagement with the top of a pile of printing stock and a raised position to permit a stock feeder to remove a sheet of stock;

first biasing means connected to and operable to urge said pile-height bar toward said lower position of engagement with the top of said pile;

second biasing means connected to and operable to reduce the force provided by said first biasing means as said pile-height bar assumes said lower position, said first and second biasing means comprising tension springs connected above and below said pile-height bar;

means, including a rotating cam means, for cyclicly operating said pile-height bar between said lower position and said raised position in synchronism with a stock feeder; and means responsive to the lower position of said pile-height bar for actuating a feed table to raise said pile of stock so as to maintain the top of said pile of stock in pre-determined relationship to said stock feeder.

* * * * *